US005634615A

United States Patent [19]

Shuen

[11] Patent Number: 5,634,615

[45] Date of Patent: Jun. 3, 1997

[54] FLEXIBLE HOSE STORAGE BOARD

[75] Inventor: Shun-Tian Shuen, San Chung, Taiwan

[73] Assignee: Janchy Enterprise Co., Ltd., Taipei Hsien, Taiwan

[21] Appl. No.: 492,154

[22] Filed: Jun. 19, 1995

[51] Int. Cl.[6] ..... A62C 35/00

[52] U.S. Cl. ..... 248/89; 211/60.1; 248/915

[58] Field of Search ..... 248/89, 90, 75, 248/908, 915, 79; 211/60.1, 70.1

[56] References Cited

U.S. PATENT DOCUMENTS

| | | | |
|---|---|---|---|
| 355,924 | 1/1887 | Favel | 248/89 |
| 603,207 | 4/1898 | Ruby | 248/90 |
| 955,260 | 4/1910 | Getman | 248/89 |
| 2,453,248 | 11/1948 | Much | 248/75 |
| 2,747,823 | 5/1956 | Swenholt | 248/89 X |
| 3,029,933 | 4/1962 | Sutter | 248/75 X |
| 4,436,267 | 3/1984 | Eads et al. | 248/75 |
| 5,005,790 | 4/1991 | Harris, III | 248/75 |
| 5,419,362 | 5/1995 | Blackaby | 248/89 X |

FOREIGN PATENT DOCUMENTS

| | | | |
|---|---|---|---|
| 2559045 | 8/1985 | France | 248/89 |
| 123222 | 12/1919 | United Kingdom | 248/89 |
| 1470048 | 4/1977 | United Kingdom | 248/908 |

*Primary Examiner*—Ramon O. Ramirez
*Assistant Examiner*—Brian J. Hamilla
*Attorney, Agent, or Firm*—Browdy and Neimark

[57] ABSTRACT

A flexible hose storage board comprising a collecting board having an ornamental article attached therewith is removably fixed to a wall onto which a flexible hose is wound in order around for storage. The hose collecting board has a plurality of spaced parallel grooves so as to permit an elongated hose to be wound in circles therein for storage. The hose collecting board is mounted to a wall near a faucet so that a hose having one end attached to a faucet and the other end having a nozzle being retained in place in the horizontal positioning hole after the hose is fully wound around the board.

1 Claim, 3 Drawing Sheets

FLEXIBLE HOSE STORAGE BOARD

BACKGROUND OF THE INVENTION

The present invention relates to a flexible hose storage board about which an elongated hose can be uniformly wound in so that hose can be readily collected for storage and can be extended quickly without tangling.

Generally a flexible hose used for watering a garden or washing a vehicle is collected by rolling up the same around an arm of a person into circles and the rolled hose kept in a storage place. However, so collected hose can be easily tangled into a mess when the hose is too long and not properly moved or delivered. It will be tedious and time consuming to arrange a long and tangled hose into proper shape for use every time.

SUMMARY OF THE INVENTION

Therefore, the primary object of the present invention is to provide a simply structured hose storage board about which a hose can be wound for storage without tangling and the wound hose can be easily extended in use.

Another object of the present invention is to provide a simply structured hose storage board which can be secured to a wall in the vicinity of a faucet so that a hose having one end thereof engaged with the faucet can be wound around the collecting board with its other end having a spray gun attached thereto retained in place in a positioning hole on the collecting board.

One further object of the present invention is to provide a simply structured hose storage board having an ornamental article, designed in different forms, attached thereto so that the board secured to a wall can be displayed in an appealing manner.

DETAILED DESCRIPTION OF THE PREFERRED EMBODIMENT

Figure 1:
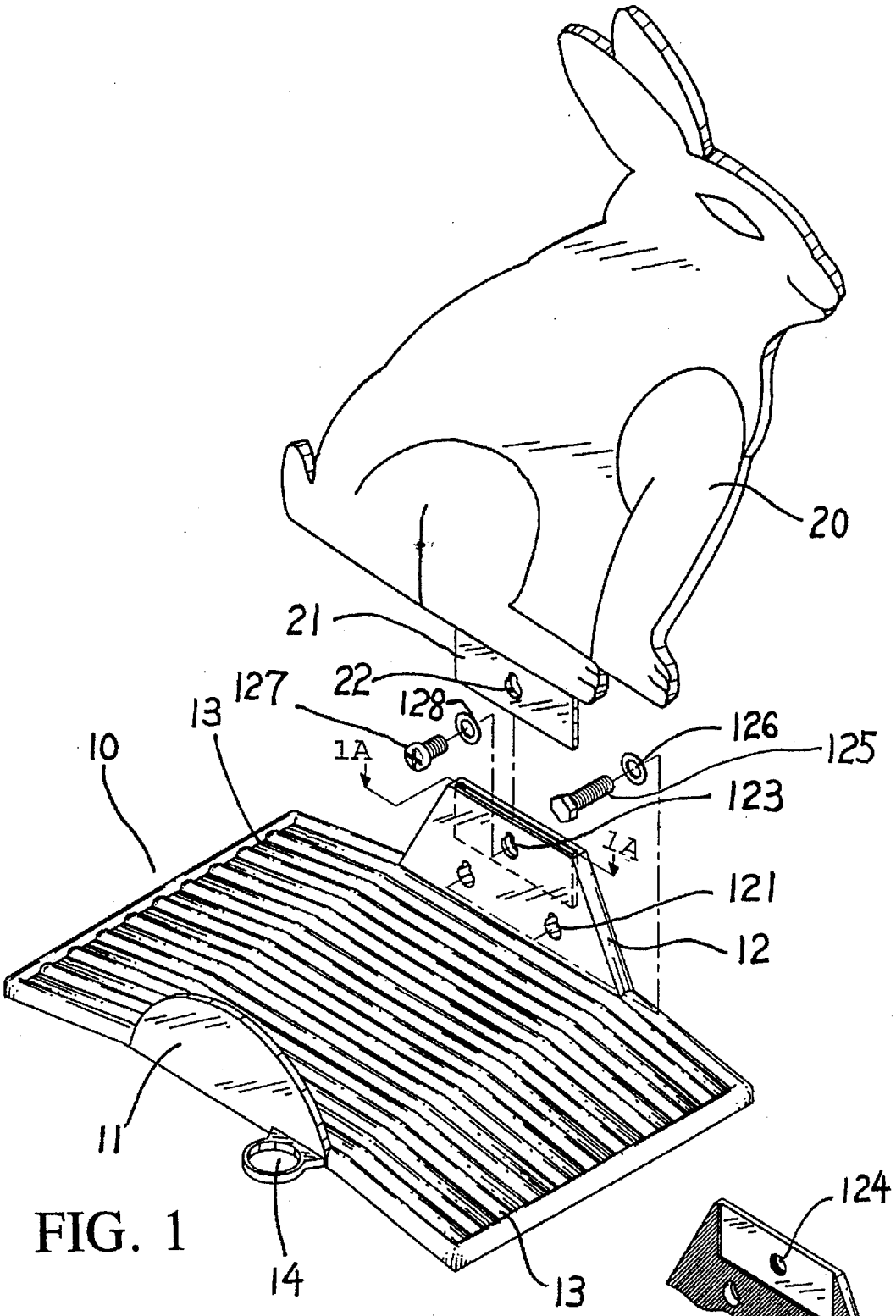
FIG. 1 is a perspective diagram showing the exploded components of the present invention.

Referring to FIG. 1, the present invention comprises a flexible hose collecting board 10 and an ornamental article 20 in combination. The collecting board 10 is slightly curved and thin, having one long edge thereof attached with a vertical stop plate 11 with a horizontal annular positioning hole 14 disposed on the vertical stop plate 11 for retaining of one end of a hose. To the opposite edge of the stop plate 11 is disposed a vertical securing plate 12 having a number of holes 121, 123 for location of fixing bolts 125 and 127. The bolts 125 led through the holes 121 and washers 126 and are used to fix the securing plate 12 and the hose collecting board 13, to a wall or the like.

An ornamental article 20 having a bottom extension 21 with a hole 22 disposed thereon is engaged with the securing plate 12 by insertion of the bottom extension 21 into a slot 122 defined on the top of the securing plate 12. The hole 22 of the bottom extension 21 is positioned in alignment with the hole 123 of the securing plate 12. The ornamental article 20 is secured in locking engagement with the securing plate 12 by the bolt 127 and a washer 128.

Figure 1A:
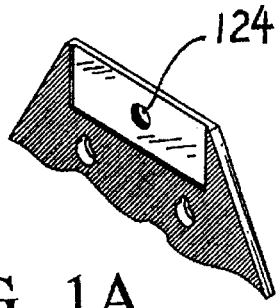
FIG. 1A is an elevation view along section A—A of FIG. 1.
Figure 2:
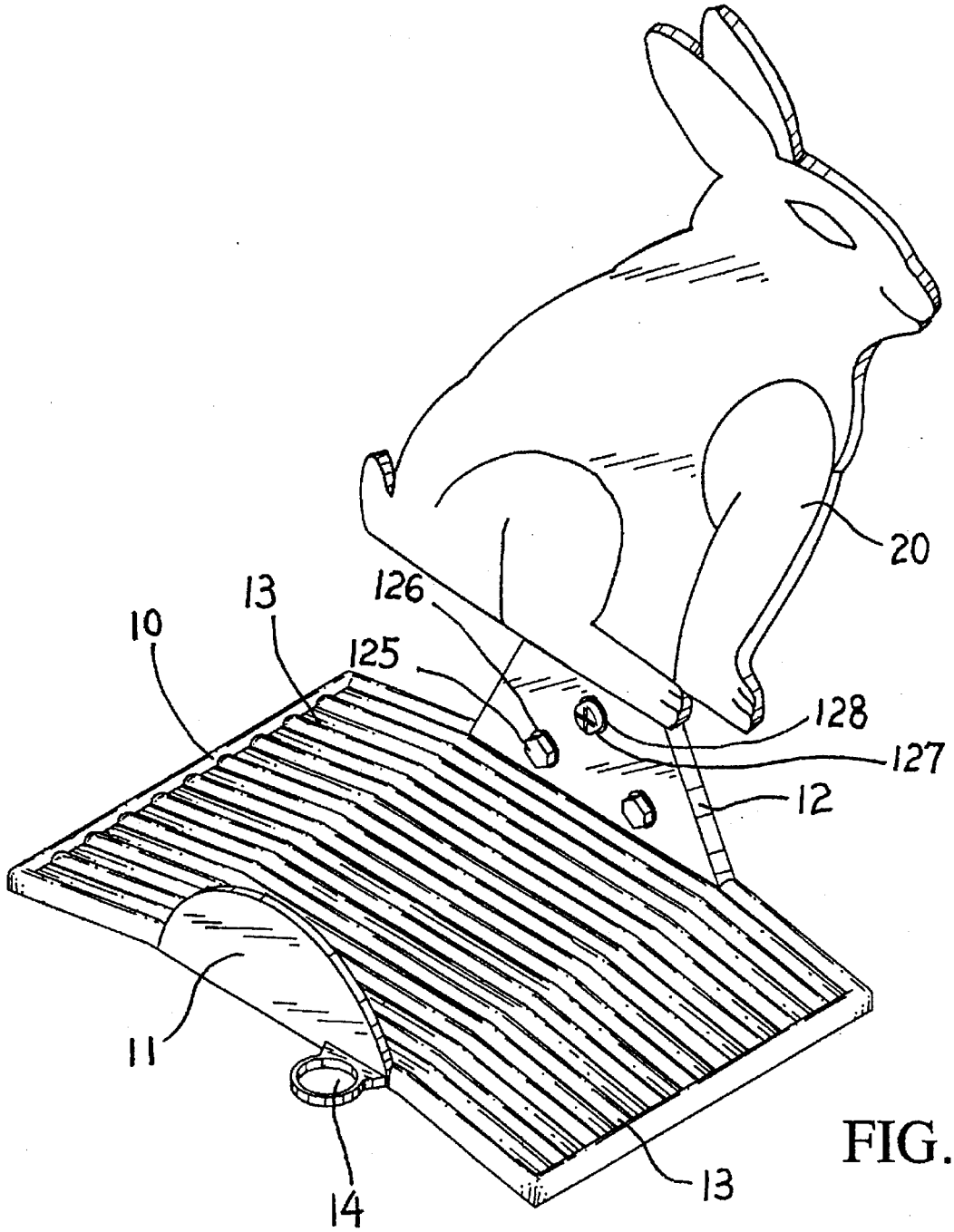
FIG. 2 is a perspective diagram showing the assembly of the present invention.

As shown in FIG. 1A, the other side of the securing plate 12 has a hole 124 in alignment with the through hole 123 so as to permit the bottom extension 21 to be inserted in the slot 122 and locked in place by the bolt 127 led through the holes 123, 124 whereby the ornamental article 20 can be removably engaged with the flexible hose collecting board 10 as a whole as shown in FIG. 2.

Referring further to FIG. 2, the flexible hose collecting board 10 is provided with a plurality of grooves 13 parallel to one another so as to permit a flexible hose 30 to be wound therearound in order. One end of the hose 30 is attached to a faucet (not shown) and the other end having a nozzle means 40 can be engaged with the horizontal annular positioning hole 14 so as to permit the hose to be firmly retained in place as it abuts against vertical stop plate 11 as shown in FIG. 3.

Figure 3:
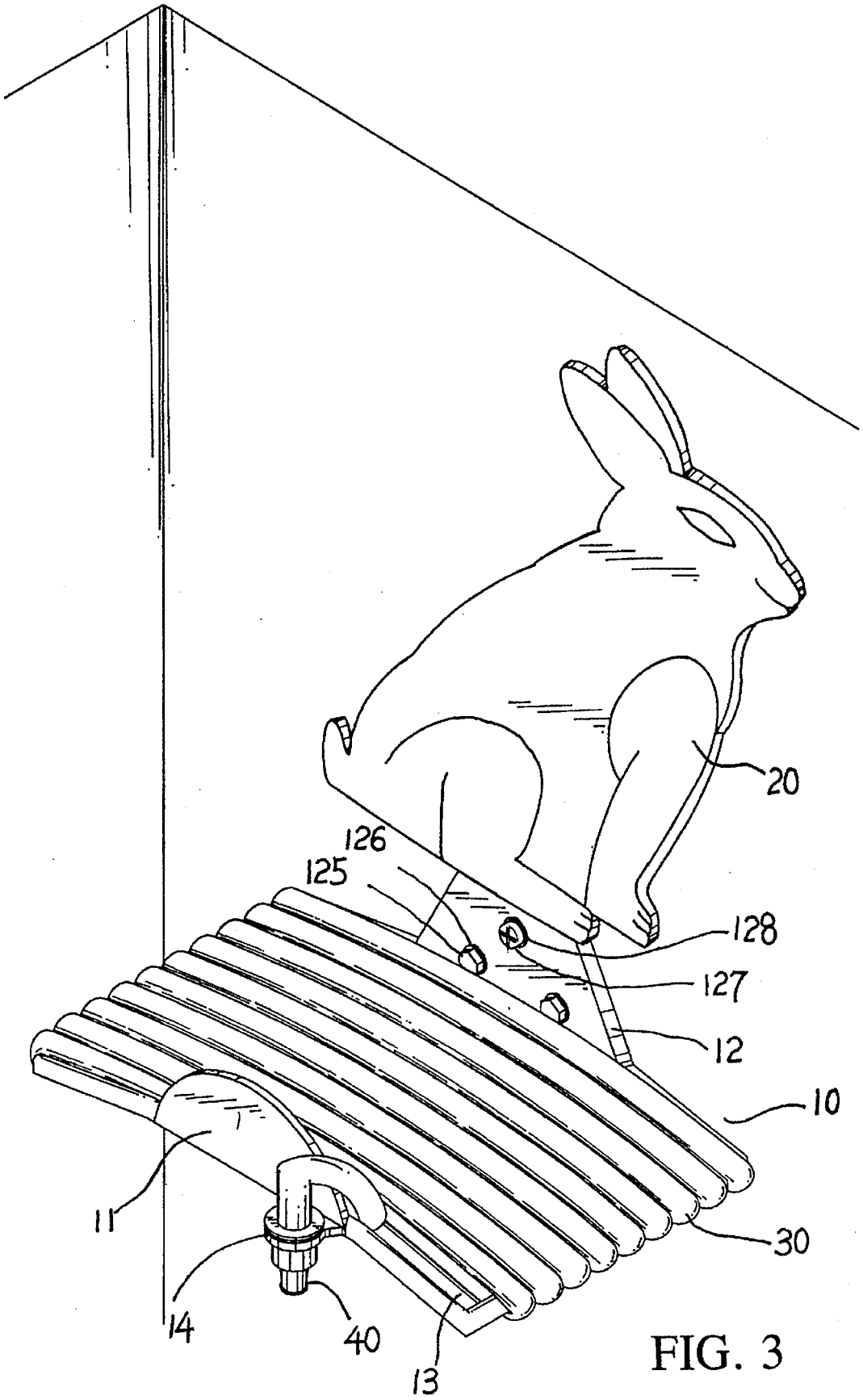
FIG. 3 is a diagram showing the practical use of the present invention.

Referring to FIG. 3, in practical use, the hose collecting board 10 is mounted to a wall by bolts 125 adjacent to a faucet (not shown) with the ornamental board 20 engaged therewith by the bolt 127, and the hose 30 is wound around the board 10 in the grooves 13. As described above, the nozzle means 40 is retained in place by engagement with the annular positioning hole 14 and vertical stop plate 11. To extend the wound hose 30 for use, one only has to pull the nozzle means 40 out of the positioning hole 14 first and make the wound hose 30 detached from the collecting board 10 circle by circle.

I claim:

1. A flexible hose storage board comprising a collecting board having a plurality of parallel grooves disposed thereon; said board having a vertical stop plate disposed on one long edge of said board; a horizontal annular positioning hole disposed on an end of said vertical stop plate; a vertical securing plate disposed opposite to said stop plate being removably secured to a wall by bolts; said securing plate having a slot defined thereon; an ornamental article having a bottom extension which is removably engaged with said slot of said securing plate and fixed in place by a bolt; whereby a flexible hose can be wound around said collecting board in said parallel groove one by one for storage with one end of said hose having a nozzle means retained in said horizontal annular positioning hole, while said one end of said hose abuts against said vertical stop plate, wherein said ornamental article is replaceable with other ornamental articles in accordance with personal preference or environmental circumstance.

* * * * *